US006146343A

United States Patent [19]

Stewart

[11] Patent Number: 6,146,343

[45] Date of Patent: Nov. 14, 2000

[54] BALL MASSAGE DEVICE

[76] Inventor: Roger K. Stewart, 30726 Stewart Hollow Rd., Middleport, Ohio 45760

[21] Appl. No.: 09/100,021

[22] Filed: Jun. 19, 1998

Related U.S. Application Data

[60] Provisional application No. 60/051,784, Jul. 7, 1997.

[51] Int. Cl.[7] ..... A61H 15/00

[52] U.S. Cl. ..... 601/118

[58] Field of Search ..... 601/118, 119, 601/115, 116, 117, 122, 124, 128, 131, 132, 136, 86, 90, 91, 97–99, 110, 134, 148; 5/633; D24/211–213; 446/220, 469, 397, 431; 482/77, 78, 146

[56] References Cited

U.S. PATENT DOCUMENTS

| | | | |
|---|---|---|---|
| D. 373,195 | 8/1996 | Hoff | D24/211 |
| 2,230,890 | 2/1941 | McClenathen | 601/122 |
| 2,638,089 | 5/1953 | Murphy | 601/27 |
| 3,088,458 | 5/1963 | Stewart | 601/122 |
| 3,164,150 | 1/1965 | Reid | 601/97 |
| 3,292,614 | 12/1966 | Fleming | 601/122 |
| 3,685,511 | 8/1972 | Alvarez | 601/115 |
| 3,716,229 | 2/1973 | Van Der Cleyen et al. | 482/77 |
| 3,759,250 | 9/1973 | Salata | 601/122 |
| 4,505,477 | 3/1985 | Wilkinson | 482/146 |
| 4,613,131 | 9/1986 | Anderson | 482/146 |
| 4,688,556 | 8/1987 | Keller, Jr. | 601/122 |
| 4,848,742 | 7/1989 | Lindley et al. | 482/142 |

FOREIGN PATENT DOCUMENTS

| | | |
|---|---|---|
| 2623409 | 5/1989 | France . |

*Primary Examiner*—Justine R. Yu
*Attorney, Agent, or Firm*—Robert N. Blackman

[57] ABSTRACT

A ball massage device is provided comprising (a) a massage ball, preferably in the form of an inflated large massage ball, (b) a platform having an elongated opening for receiving a top portion of the massage ball, and (c) a curvilinear (arcuate) base depending from the platform and having an opening for receiving a lower portion of the massage ball. During use of the device, the massage ball is effectively retained within the device by the platform and base which permit portions of the massage ball to extend therefrom. The portion of the massage ball extending above the platform engages the user's back and permits adequate massaging and exercising of the user's back and other body portions. Alternatively, the massage ball may be retained in a position relative to the platform by utilization of a ball retention assembly comprising a pair of spaced apart tracks positioned on opposite lateral sides of the opening and having retainer cups attached to a track runner within the tracks for engagement of the retainer cups with the massage ball and permitting movement of the retainer cups relative to the opening by movement of the runners within the tracks.

7 Claims, 3 Drawing Sheets

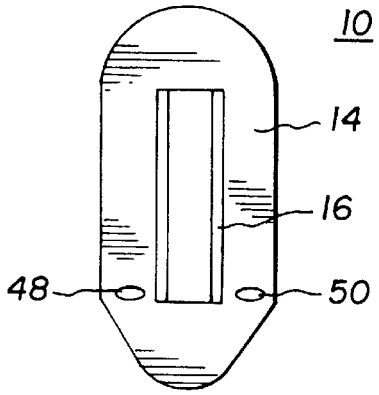
FIG. 4
FIG. 6
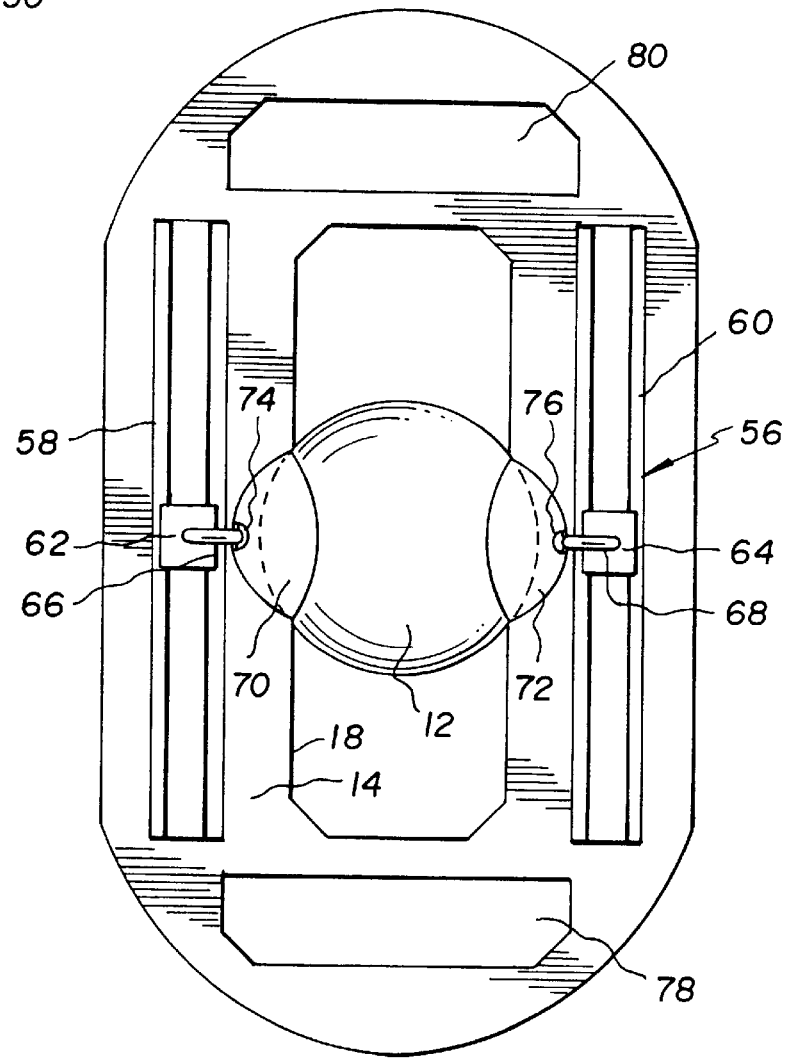
FIG. 5
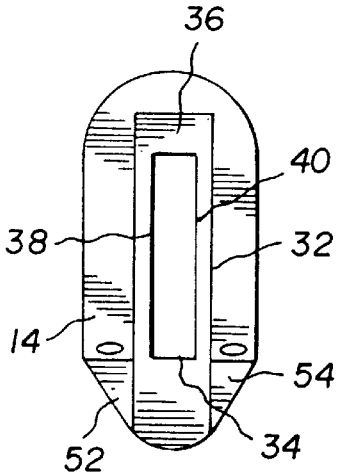

BALL MASSAGE DEVICE

This application claims the benefit of U.S. Provisional No. 60/051,784 filed Jul. 7, 1997.

BACKGROUND OF THE INVENTION

1. Field of the Invention

The present invention relates to massaging devices, and more particularly relates to ball-type massaging devices.

2. Description of the Related Art

Large massage balls have been previously disclosed for their use in exercising legs and back. Conventional massage balls which have been used by the user reclining on the ball and moving backwards and forwards with the ball at a position underneath their back have been disclosed. A problem with individuals having balance problems, for example some elderly individuals, is that when use of such massage balls is attempted the user can experience difficulty in maintaining balance and proper usage of the massage balls.

Consequently, there is a need and desire to provide a system for utilization of massage balls and exercise programs which will provide enhanced stability and ease of use for people including people having some difficulty maintaining balance on conventional massage balls.

SUMMARY OF THE INVENTION

The present invention involves a ball massage device comprising of (a) a massage ball, preferably in the form of an inflated large massage ball; (b) a platform having an elongated opening for receiving a top portion of the massage ball, and (c) a curvilinear (arcuate) base depending from the platform and having an elongated opening for receiving a lower portion of the massage ball. During use of the device, the massage ball is effectively retained within the device by the platform and base which permit portions of the massage ball to extend therefrom, and permit the ball to move within the elongated device between the base and plateform. The portion (top portion) of the massage ball extending above the platform engages the user's back and permits adequate massaging and exercising of the user's back and other body portions. The portion (bottom portion) of the massage ball extending through the base engages the floor. Alternatively, the massage ball may be retained in a position relative to the platform by utilization of a ball retention assembly comprising a pair of spaced apart tracks positioned on opposite lateral sides of the opening and having retainer cups attached to a track runner within the tracks for engagement of the retainer cups with the massage ball and permitting movement of the retainer cups relative to the opening by movement of the runners within the tracks.

BRIEF DESCRIPTION OF THE DRAWINGS

FIG. 4 is a top plan view of a ball massage device according to the present invention with the ball removed therefrom;

FIG. 5 is a bottom plan view of the device of FIG. 4;

FIG. 6 is a bottom plan view of an alternative embodiment of the device of the present invention;

DETAILED DESCRIPTION OF THE INVENTION

Figure 1:
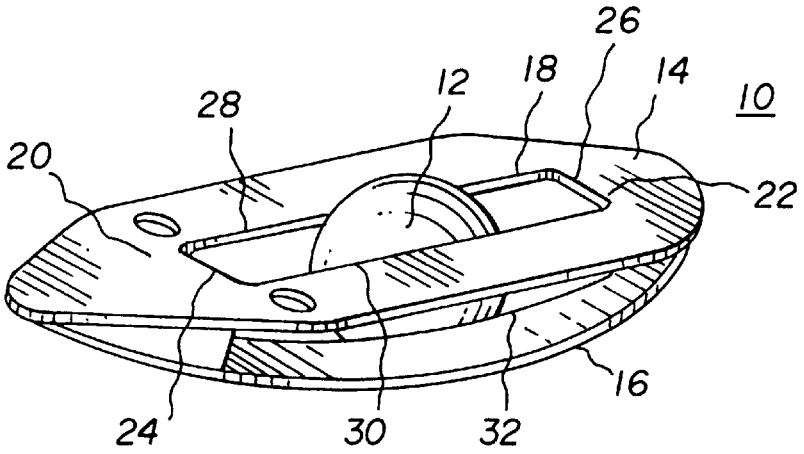
FIG. 1 is a perspective view of a ball massage device according to the present invention.
Figure 2:
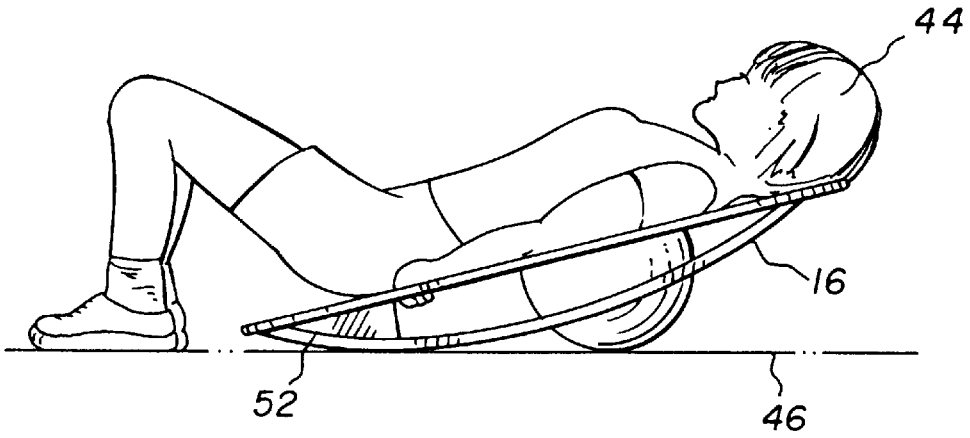
FIG. 2 is a side elevational view of a ball massage device being used by a user.
Figure 3:
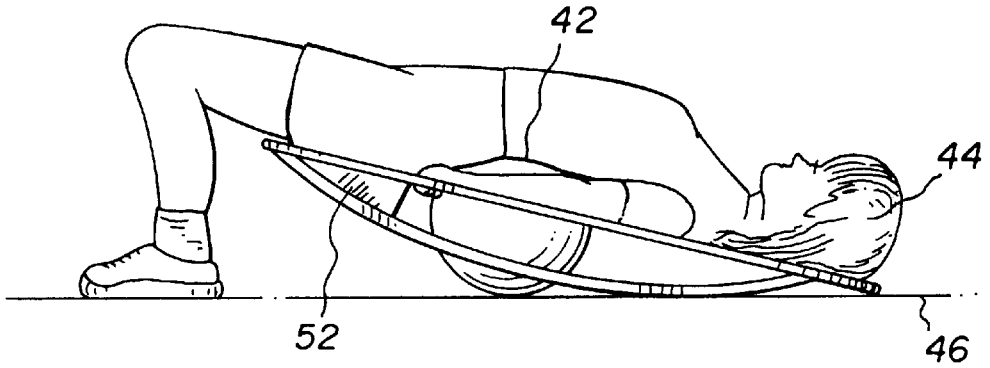
FIG. 3 is a side elevational view of a ball massage device being used by a user and being in a fully declined position.

As best shown in FIGS. 1, 2 and 3, the present invention involves a ball massage device (10) comprising a large inflated ball (12), a top platform (14), and a convex curvilinear (arcuate) base (16) depending from the platform (14).

The platform (14) has an elongated opening (18) which is preferably substantially rectangular in shape and extends from a forward portion (20) of the platform (14) to a rearward portion (22) of the platform (14). The opening preferably has a straight foremost leading edge (24) a rear trailing edge (26) and a pair of spaced apart side edges (28), (30) extending from the leading edge (24) to the rear edge (26), thereby forming the rectangular opening (18).

The base (16) has an arcuate elongated aperture (32) having a leading edge (34) a rear edge (36) spaced apart therefrom and a pair spaced apart therefrom, and a pair of spaced apart side edges (38), (40) extending arcuately from the leading edge to the rear edge to provide the substantially rectangular and arcuate aperture (32). The ball (12) is preferably inflated to permit some conformity with the user's back and exhibits some compressibility. The compressibility of the ball (12) allows the ball to be forced through either the opening (18) or the aperture (32) to be effectively retained between the platform (14) and the base (16) during use. A top region of the ball (12) will extend through the opening (18) and above the platform (14) for engaging a back (42) of a user (44). A bottom portion of the ball (12) extends downwardly through the aperture (32) and beneath the adjacent portion of the base (16) into engagement with floor (46). Preferably the relative diameter of the ball (12) to the width of the opening (18) and the width of the aperture (32) is such that the diameter of the ball is larger than the width of either the opening or the aperture to effectively retain the ball (12) within the device (10) and between the platform (14) and base (16).

The platform (14) preferably has holes (48, 50) positioned on opposite sides of the front end of the opening (18) serve as handholds (48, 50) for the user's hands. These handholds (48, 50) provide additional stability to the user (48) during exercise.

Preferably the device further has arcuate side panels (52, 54) extending between the outer edges of the platform and the base adjacent the forward portion (20) of the platform (14) for providing additional stability and movement flexibility of the device during inclined motion.

As shown in FIG. 2, the user (44) initially positioned the user's back (42) onto the platform (14) with the platform (14) in a generally inclined position and the user's hands positioned within the respective handholds (48, 50). The user (44) may then rock backward on the device (10) to cause the ball (12) to move within the opening (18) and aperture (32) from a rearward position to a forward position resulting in the platform (14) being in a decline orientation as shown in FIG. 3.

As shown in FIG. 4, it is further preferred that the width of the aperture (32) be slightly narrower than the width of the opening (18) to further facilitate the ability of the device (10) to be effectively rocked.

As best shown in FIG. 5, the aperture (32) has a leading edge (34), a rear edge (36) and a pair of spaced apart side edges (38, 40).

As shown in FIG. 6, an alternative embodiment is provided wherein the arcuate base (16) is not utilized, but rather instead a track system (56) is utilized comprising a pair of spaced apart tracks (58, 60) depending from the platform (14) and positioned on opposite sides of the elongated opening. The tracking system (56) further includes for each track a respective track runner (62, 64) which is movable along the track and within the track. Each track runner has depending therefrom and extending inwardly a support arm (66, 68). The track system further includes for each respective arm a retainer cup (70, 72) pivotally attached to the respective arm (66, 68) such as by a ball and joint arrangement (74, 76) optionally depending from the bottom of the platform (14) at the forward portion and the rearward portion are respective protective pads (78,80) for protecting the exercise floor from potential scuffing engagement with the platform (14).

Figure 7:
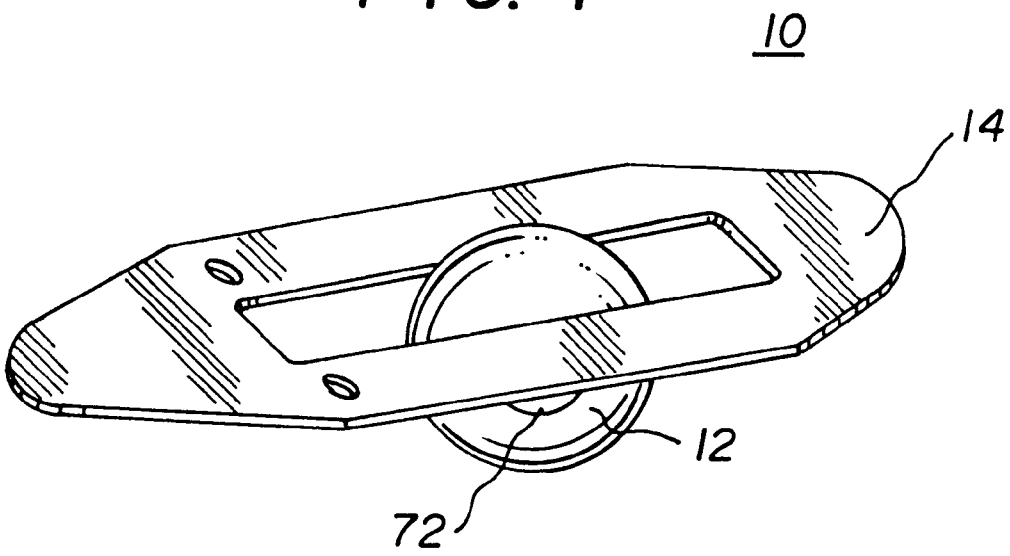
FIG. 7 is a perspective view of an alternative embodiment and the present invention.
Figure 8:
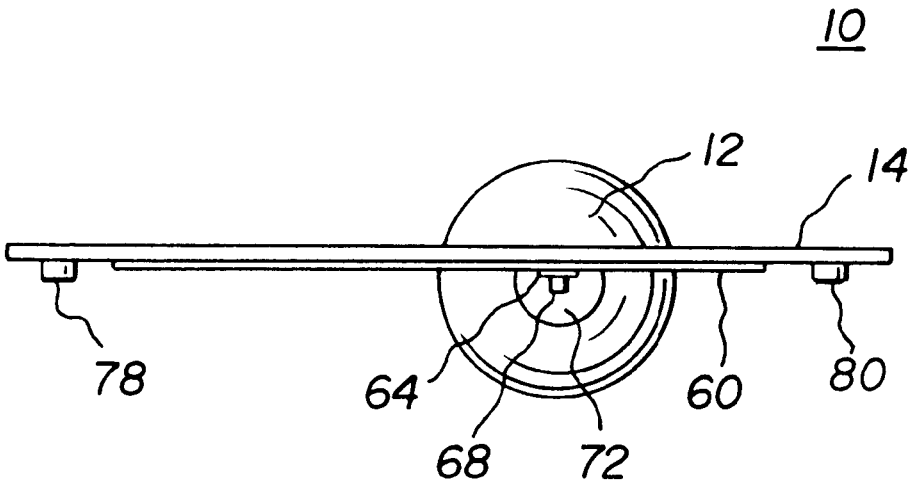
FIG. 8 is a side elevational view of the device of FIG. 7.

As shown in FIG. 7, a perspective view of the alternative embodiment of the device is shown, and as shown in FIG. 8 a side elevational view of the alternative embodiment is shown.

The device can be used to massage and loosen the lower back, and at the same time setups can be done with the device. The device also makes it easier to do leg lifts. The device is easy to use and can be used by the user simply laying down of the user's back with the device put under the user's back with the user's feet on the floor. The user can then raise the user's knees The handholds permit the user to stabilize and balance the user's weight on the device. By slowly pushing with the user's feet, the ball will roll up and down the user's spine, loosing up the back muscles of the user. As the user rolls the ball toward the user's hips, the user's shoulders will be close to the floor, and the user's hips will be elevated to a higher position from which it will be easier for the user to do leg lifts and other exercises. As the ball moves backwards toward the user's shoulders, the user raises the user's hands over the user's head in a rocking position to make it easier to do quarter situps and tightening of stomach muscles. The devices allows for simple, easy exercises without much muscle straining.

What is claimed is:

1. A ball massage device comprising:

(a) an inflatable massage ball having a non-inflated state and an inflated state;

(b) an elongated platform having means defining an elongated opening; said elongated opening dimensioned to allow only a top portion of said inflatable ball in said inflated state to extend through said elongated opening;

(c) a non-planar, arcuate base depending from said platform, said arcuate base having means defining an elongated arcuate aperture spaced apart from said means defining said elongated opening;

(d) said aperture dimensioned to allow only a bottom portion of said inflatable ball in said inflated state to extend through said aperture to thereby trap said ball between said elongated platform and said arcuate base when in said inflated state.

2. The ball massage device of claim 1, wherein said inflatable massage ball is dimensioned such that in said deflated state said inflatable ball can be removed through said elongated opening.

3. The ball massage device of claim 1, further comprising a plurality of means defining hand holds, wherein a user lying on said ball massage device may grasp said elongated platform by said hand holds to secure the user thereon.

4. The ball massage device of claim 1 wherein said massage ball provides a pivot point for rocking said elongated platform back and forth about said massage ball.

5. The ball massage device of claim 4, wherein said massage ball is dimensioned to slide within said means defining said opening while said elongated platform is rocked back and forth about said massage ball.

6. The ball massage device of claim 4, wherein said means defining said elongated opening extends more than half the length of the elongated platform.

7. The ball massage device of claim 6, wherein said elongated opening extends more than 75% of the length of the platform.

* * * * *